US010267227B2

(12) United States Patent
Nemeth et al.

(10) Patent No.: US 10,267,227 B2
(45) Date of Patent: Apr. 23, 2019

(54) SYSTEMS FOR THE REDUCTION OR ELIMINATION OF INTAKE VALVE DEPOSITS IN GASOLINE DIRECT INJECTION ENGINES AND RELATED METHODS

(71) Applicant: CRC Industries, Inc., Warminster, PA (US)

(72) Inventors: Melodee Nemeth, Celebration, FL (US); Julie Williams, Perkasie, PA (US)

(73) Assignee: CRC Industries, Inc., Warminster, PA (US)

( * ) Notice: Subject to any disclaimer, the term of this patent is extended or adjusted under 35 U.S.C. 154(b) by 0 days.

(21) Appl. No.: 15/512,411

(22) PCT Filed: Sep. 16, 2015

(86) PCT No.: PCT/US2015/050479

§ 371 (c)(1),
(2) Date: Mar. 17, 2017

(87) PCT Pub. No.: WO2016/044452

PCT Pub. Date: Mar. 24, 2016

(65) Prior Publication Data

US 2017/0248075 A1 Aug. 31, 2017

Related U.S. Application Data

(60) Provisional application No. 62/051,713, filed on Sep. 17, 2014.

(51) Int. Cl.
*F02B 77/04* (2006.01)
*B65D 83/14* (2006.01)
(Continued)

(52) U.S. Cl.
CPC ..... *F02B 77/04* (2013.01); *B65D 83/14* (2013.01); *B65D 83/306* (2013.01); *B65D 83/32* (2013.01);
(Continued)

(58) Field of Classification Search
CPC .... F02B 77/04; F02B 2077/045; B65D 83/38; B65D 83/14; B65D 83/306
(Continued)

(56) References Cited

U.S. PATENT DOCUMENTS 3,130,873 A * 4/1964 Klutz, Jr. ..... B65D 83/206 222/131
3,951,614 A * 4/1976 Honnen ..... C08G 18/3225 44/331
(Continued)

FOREIGN PATENT DOCUMENTS

WO WO 1995/028236 A1 10/1995
WO WO 2002/046350 A1 6/2002
WO WO 2003/062626 A1 7/2003

OTHER PUBLICATIONS

PCT International Search Report and Written Opinion dated Dec. 17, 2015 in counterpart PCT application No. PCT/US2015/050479 (7 pages).
(Continued)

*Primary Examiner* — Donnell A Long
(74) *Attorney, Agent, or Firm* — Calderone Bullock LLC

(57) ABSTRACT

The invention includes a system to reduce deposits from a surface of an intake valve, preferably in a GDI engine. The system includes a delivery device having a reservoir for holding a cleaning agent. The reservoir has a body that defines an interior space, and an outlet port in fluid communication with the interior space of the reservoir body. The delivery device has a delivery conduit that extends from the
(Continued)

outlet port and terminates at a distal end. The proximal end of the delivery conduit is in fluid communication with the outlet port. An actuator having an open position and a closed position is included in the delivery device. Upon activation of the actuator from a closed position to an open position, a portion of the cleaning agent flows from the interior space through the outlet port and is delivered under pressure to distal end of the delivery conduit. The cleaning agent includes a detergent, a carrier, and an oil. In a preferred embodiment, the system is an aerosolized. Also contemplated with the scope of the invention are related methods of removing deposits from the surface of an intake valve and/or of enhancing or improving engine performance.

39 Claims, 4 Drawing Sheets

(51) Int. Cl.
*B65D 83/30* (2006.01)
*B65D 83/32* (2006.01)
*B65D 83/38* (2006.01)

(52) U.S. Cl.
CPC ..... *B65D 83/38* (2013.01); *F02B 2077/045* (2013.01)

(58) Field of Classification Search
USPC ..... 222/131, 183
See application file for complete search history.

(56) References Cited

U.S. PATENT DOCUMENTS 4,191,537 A * 3/1980 Lewis ..... C08G 65/3331 44/334
4,807,578 A * 2/1989 Adams ..... F02B 77/04 123/179.8
5,006,130 A * 4/1991 Aiello ..... C10L 1/143 123/1 A
5,097,806 A * 3/1992 Vataru ..... F02B 77/04 123/198 A
5,749,929 A * 5/1998 Cherpeck ..... C07C 205/57 44/387
5,858,942 A * 1/1999 Adams ..... B65D 83/756 123/1 A
8,466,330 B2 6/2013 Bauldreay et al.
2003/0015554 A1* 1/2003 Gatzke ..... F02B 77/04 222/181.2
2003/0158061 A1* 8/2003 Ahmadi ..... C11D 1/72 510/185
2011/0308550 A1* 12/2011 Reid ..... C10L 10/00 134/20

OTHER PUBLICATIONS

PCT International Preliminary Report on Patentability dated Mar. 21, 2017 in counterpart PCT application No. PCT/US2015/050479 (5 pages).

* cited by examiner

SYSTEMS FOR THE REDUCTION OR ELIMINATION OF INTAKE VALVE DEPOSITS IN GASOLINE DIRECT INJECTION ENGINES AND RELATED METHODS

CROSS REFERENCE TO RELATED APPLICATION

This application claims the benefit of priority under 35 U.S.C. § 119(e) to U.S. Provisional Patent Application No. 62/051,713, filed Sep. 17, 2014, entitled "Systems For the Reduction or Elimination of Intake Valve Deposits in Gasoline Direct Injection Engines and Related Methods", the entire disclosure of which is incorporated herein by this reference.

BACKGROUND OF THE INVENTION

A modern and efficient variant of fuel injection technology used in modern two-stroke and four-stroke gasoline engines is Gasoline Direct Injection (GDI), sometime referred to as "Petrol Direct Injection", "Direct Petrol Injection", "Spark Ignited Direct Injection" (SIDI) or "Fuel Stratified Injection" (FSI), depending on the geography. In GDI engines, the gasoline is highly pressurized and is injected via a common rail fuel line directly into the combustion chamber of each cylinder, as opposed to conventional multi-point fuel injection that happens in the intake tract, or cylinder port.

GDI engines are prevalent in consumer vehicles and in commercial car and truck fleets because of the advantages associated with the GDI technology. For example, GDI engines exhibit increased fuel efficiency and high power output as compared to standard fuel injection engines, such as port fuel injection ("PFI") engines. Emissions levels may also be more accurately controlled with the GDI system. In addition, there are minimal throttling losses in some GDI engines, when compared to a conventional fuel-injected or carbureted engine, which greatly improves efficiency and reduces 'pumping losses' in engines without a throttle plate.

However, although direct injection technology is reported to provide several advantages it is plagued with a significant drawback. Carbon build-up occurs in the intake valves that, over time, reduces the airflow to the cylinders, and therefore reduces power. In the conventional standard fuel injection or PFI engines, these deposits were removed by the fuel (often containing detergents) cleaning the surfaces of the valves as it was introduced into the combustion chamber. Because GDI engines inject the fuel directly into the combustion chamber, this cleaning effect is no longer performed. The build-up of the intake valve deposits may produce performance problems including decreased power and torque, lower fuel economy, higher emissions, starting issues, hesitation, pinging and rough idle. Additionally, small amounts of dirt from intake air may also attach to the intake walls. It has been reported that this build-up can result in break off that can travel downstream in the system and potentially result in catastrophic damage, such as holes in catalytic converters or sporadic ignition failures.

Currently the only effective methods available to clean these deposits is time consuming and expensive. The most effective ways involve disassembling the engine, removing the intake valves and blasting the deposits away by using walnut shells or other abrasives or by introducing straight solvents into the air intake system by specialized attachments performed by a licensed mechanic. Both of these methods are time consuming and come with a significant cost to the consumer.

A prior art attempt to develop resource efficient cleaning method was made by Wynnoil in the UK (sold under the name "Direct Injection Power"). The Wynnoil product used an aerosol device that was intended to deliver a cleaning formula of rapidly evaporating solvents to the intake surfaces. However, the Wynnoil product proved ineffective for several reasons relating to the structure of the dispenser and the composition of the cleaning fluid.

Thus, there remains a need in the art for systems and methods of effectively cleaning intake valve surfaces in situ in a GDI engine that is cost and time effective, easily carried out by an average automobile consumer, thereby permitting enjoyment of the benefits of a GDI engine without the performance limiting and/or potentially dangerous disadvantages associated with deposit build up.

BRIEF SUMMARY OF THE INVENTION

The invention includes a system to reduce deposits from a surface of an intake valve, preferably in a GDI engine. The system includes a delivery device having a reservoir for holding a cleaning agent. The reservoir has a body that defines an interior space, and an outlet port in fluid communication with the interior space of the reservoir body. The delivery device has a delivery conduit that extends from the outlet port and terminates at a distal end. The proximal end of the delivery conduit is in fluid communication with the outlet port. An actuator having an open position and a closed position is included in the delivery device. Upon activation of the actuator from a closed position to an open position, a portion of the cleaning agent flows from the interior space through the outlet port and is delivered under pressure to distal end of the delivery conduit. The cleaning agent includes a detergent, a carrier, and an oil. In a preferred embodiment, the system is an aerosol.

Also contemplated with the scope of the invention are related methods of removing deposits from the surface of an intake valve and/or of enhancing or improving engine performance.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

The invention described herein relates to systems and methods for the reduction or elimination of intake valve deposits and for the improvement of performance characteristics of a vehicle that has been driven 5,000 miles or more, such as increased power and torque, fuel economy and reduced emissions. The systems and methods described herein are particularly suitable for gasoline direct injection engines, although they are effective in PFI engines as well.

In GDI engines, the fuel is injected directly into the combustion chamber. Because it does not make contact with the intake valves, the valves in a GDI engine are not cleaned by the fuel (solvent) in daily operation of the engine. Consequently, deposits build up rapidly on the surfaces of the intake valves.

The inventors have discovered a unique combination of delivery device architecture and cleaning agent composition that enables one using the system to deliver a targeted dosage of cleaning agent substantially directly to the intake valve surfaces, where the deposits are localized, without substantial disassembly of the engine. Once delivered, the cleaning agent is specifically formulated to remain on the surfaces (i.e., not volatize substantially immediately) for a sufficient time to solubilize the deposits before volatilizing or otherwise breaking down. Advantageously, no substantial disassembly of the engine or manifold is necessary as the inventors have designed the system to utilize the geometry of the intake manifold to facilitate targeted delivery of the cleaning agent.

Figure 1:
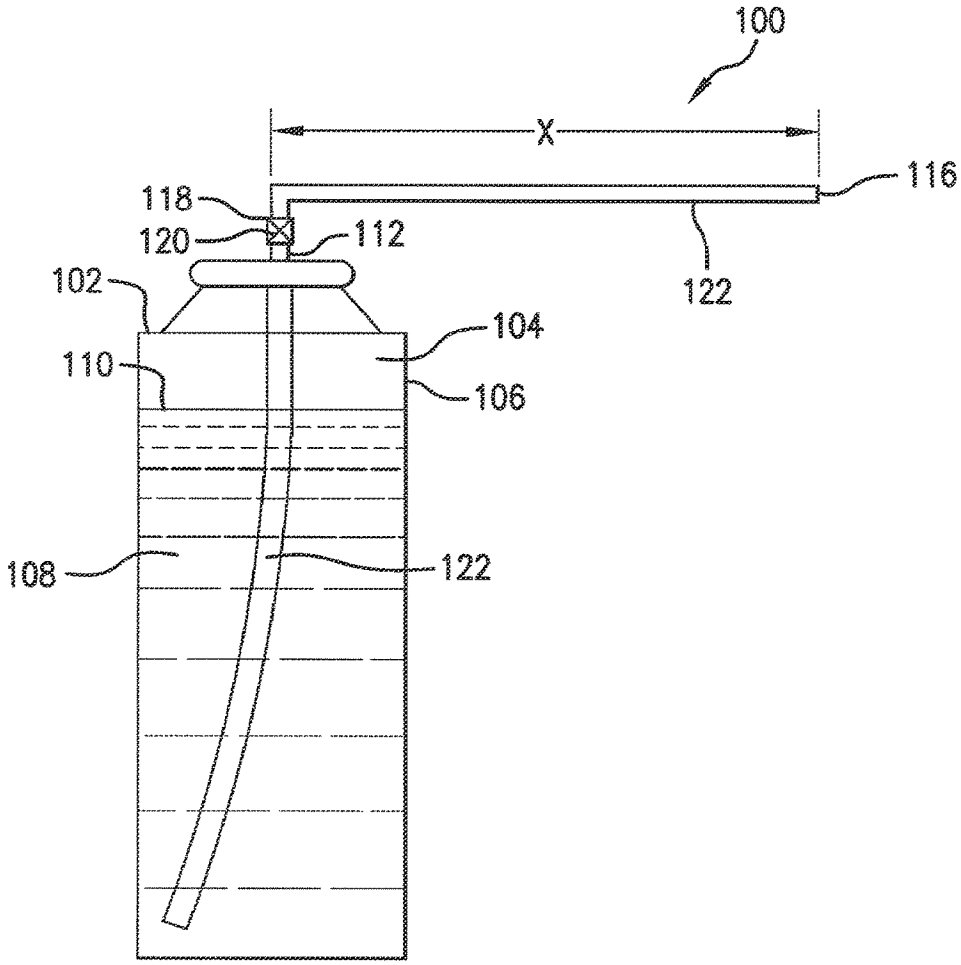
FIG. 1 is a schematic drawing of an embodiment of the system of the invention.
Figure 2:
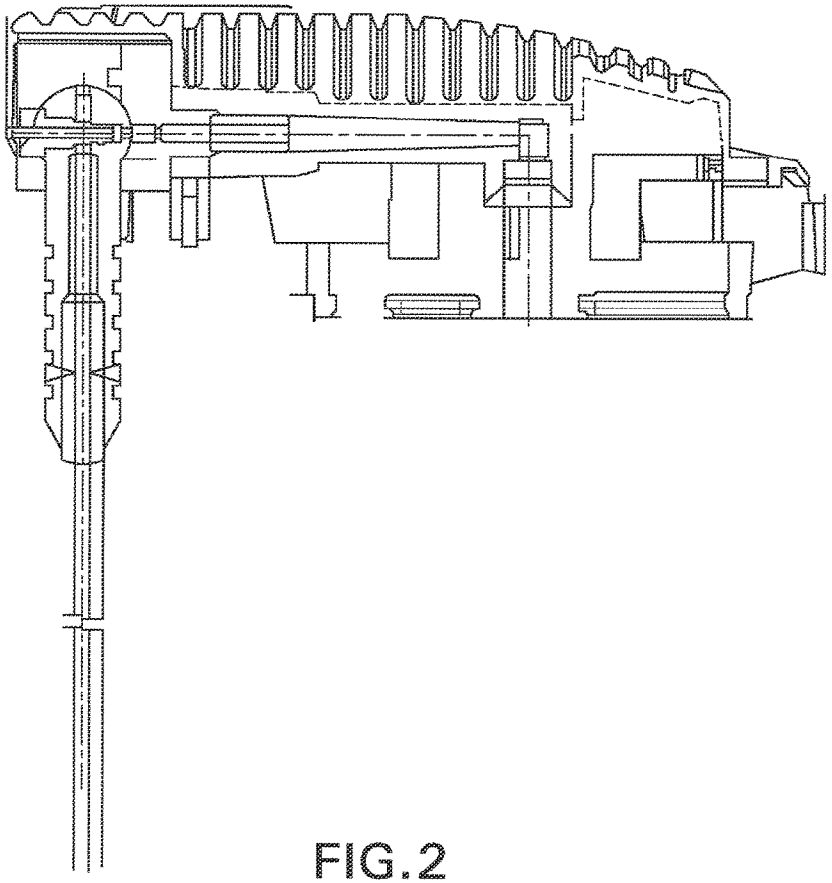
FIG. 2 is an illustration of a portion of the dispensing device of the system of FIG. 1.

Referencing FIGS. 1 and 2, the system 100 includes a delivery device 102. The delivery device 102 includes a reservoir 104 that has a body 106 defining an interior space 108. The reservoir and the reservoir body may be fabricated out of any material known or used in the art. Suitable materials may independently include, for example, metal, plastic (rigid or flexible), fiberglass or glass. As will be understood by a person of skill in the art, the material(s) selected in a particular embodiment may vary depending on the format that the cleaning agent is to be delivered, i.e., an atomized delivery may dictate use of a different material for the reservoir than an aerosol delivery.

The size of the reservoir and/or the body may vary. In some embodiments, it may be preferred that the reservoir and/or the body is sized to hold a single application or dosage. In such embodiments, the interior space has a volume that is capable of holding, for example, about 150 to about 300 grams of cleaning agent or about 200 to about 250 grams of cleaning agent. If an aerosol propellant is to be included in the reservoir 104, additional volume within the interior space may be necessary to accommodate the propellant and to facilitate aerosolization. Such modifications of size and scale are with the average expertise of a skilled artisan.

In some embodiments, the reservoir is disposed within an additional housing (not shown). The housing may be in any format, for example, a box, a can, a bag or other container or it may merely be a covering that conforms to the shape of the reservoir.

The system 100 includes a cleaning agent 110 that is disposed within the interior space 108 of the reservoir 104. Optionally a propellant (not shown) may be included in the reservoir in some embodiments, if the cleaning agent is to be delivered in aerosolized format.

The cleaning agent 110 that is held by the reservoir 104 includes at least three components: a detergent, a carrier, and an oil.

The detergent may include any known or to be developed in the art that is capable of solubilizing carbon deposits and mixtures of such detergents. Preferred are detergents that act to remove or reduce carbon deposit within about 15 minutes to about 90 minutes after contact with the deposit. As an illustration, suitable detergents may include polyether amines, polyisobutylenes, (PIB)-Minnichs, (PIB)-amines, (PIB)-succinimide and mixtures thereof. Others my include those disclosed in U.S. Pat. Nos. 3,951,614 and 3,766,520, the contents of each of which are incorporated herein by reference. In some embodiments, a preferred detergent may be one or more polyether amine or polyether amine derived detergents.

In some embodiments of the invention, commercially available detergent blends may be used, such as, for example, POWERZOL 9543, AFTON HI-TEC 6431, and CHEVRON TECHRON concentrate.

Also included in the cleaning agent is a carrier. In some embodiments, it is preferred that the carrier is a petroleum distillate or synthetic aliphatic hydrocarbon. The carrier may be, for example, a diesel fuel (e.g., a controlled evaporation no. 2, low sulfur diesel fuel), or biodiesel. In some embodiments, it may be preferred that the compound(s) selected as the carrier have a low vapor pressure, that is, a vapor pressure substantially the same or lower than the vapor pressure of diesel fuel.

The cleaning agent further includes an oil. The oil may be a synthetic or a petroleum derived oil. It may be, for example, a polyol, a high molecular weight mineral oil, a polyalphaolefin, a polyether, and esters and/or mixtures of these.

In some embodiments, it is desirable that the cleaning agent is composed of 50% or more by weight of detergent. Alternatively, it may be about 50% to about 70%, about 60% to about 80%, about 75% to about 90% by weight of the total cleaning agent.

In some embodiments the carrier may be present in the cleaning agent in amounts of, for example, about 20% to about 50% or about 30% to about 40% by weight of the total cleaning agent. The oil of the cleaning agent may be included in a minimal amount. For example, it may be present in the cleaning agent in amounts of about 0.1%, 0.2% to about 5%, about 0.5% to about 3%, or about 0.8% to about 2% by weight of the total cleaning agent.

As desired, other components may be present in the cleaning agent—for example, processing aids, components that impart shelf stability or safety attributes, colorants, odorants, etc.

If it is desired that the cleaning agent is to be dispensed in an aerosol format, the reservoir may further contain a propellant or mixture of propellants. Any known or to be developed in the art may be used. Suitable propellants may include compressed gas and soluble gas propellants, as well as liquefied propellants. Suitable examples may be nitrogen gas, carbon dioxide, nitrous oxide, compressed air, dimethyl ethers (DMEs), hydrofluorocarbons (HFCs), hydrofluoroolefins (HFOs) and hydrocarbon propellants.

In an embodiment, hydrocarbon propellants and blends of hydrocarbon propellants are preferred. Examples may include methanes, ethanes, propanes, butanes and pentanes and blends known in the art as A-46 (15.2% propane/84.8% isobutane), NP-46 (25.9% propane/74.1% N-butane), NIP-46 (21.9% propane/31.3% isobutane/46.8% N-butane) and A-70 (31% propane, 23% isobutane, 46% n-butane). Regardless, of the blend selected, it may be desirable that the blend is a 70 psig blend, in certain embodiments.

As will be understood to a person of skill in the art, the amount of propellant added to the reservoir will vary depending on numerous factors, including the volume of the reservoir and the amount and specific chemical properties of the cleaning agent present. However, it has been found that one may wish to include the propellant in an amount of about 20% to about 60% by weight of the cleaning agent and the propellant (that is, the total of the weight of the cleaning agent+the weight of the propellant), or in an embodiment, preferably about 25% to about 30% by weight of the cleaning agent and the propellant.

The reservoir 104 has an outlet port 112 that is in fluid communication with the interior space 108 and the delivery conduit 114. The term "fluid" as used herein, is used in its fullest meaning, and encompasses conventional fluids, vapors, gases and mixtures of the same. The delivery conduit 114 extends from the reservoir body 106 and terminates in a distal end 116; its proximal end 118 is in fluid communication with the outlet port 112. In some embodiments, the delivery conduit may be detachably affixed to the delivery device.

The length of the delivery conduit may vary; in an embodiment it may be preferred that the delivery conduit 114 extends a length from the outlet, reservoir and/or housing that is sufficient to permit placement of the distal end 116 of the delivery conduit in front of an engine's mass flow sensor in the practice of the method of the invention, to avoid contact of the mass flow sensor with the cleaning agent 110. In some embodiments therefore, the length "x" of the delivery conduit 114 may be about 1 to about 30 inches, about 5 to about 20 inches, or about 10 to about 17 inches from the outlet port 12.

The delivery device 102 also includes an actuator 120 that is disposed between the interior space 108 of the reservoir 104 and the distal end 118 of the delivery conduit 114. The actuator 102 is capable of being in an open position, allowing the passage of the cleaning agent 110 from the interior space 108 of the reservoir 104 to the distal end 118 of the delivery conduit 114, and a closed position, in which the cleaning agent 110 is prevented from entering the delivery conduit 114. The actuator can be mechanically operable, electronically operable, and/or electromechanically operable. Actuators to regulate fluid flow in aerosolized, atomized or conventional fluid flow systems are well known in the art, and any of these may be used in embodiments of the invention. In some embodiments, it may be preferred that the actuator includes a conventional male or female valve disposed between the interior space and the outlet port, wherein the stem of the valve is unitary with an external button or stem that extends from the outlet port, enabling a user to open the valve.

Generally, one may utilize the system as follows: A vehicle, such as a conventional consumer's car, is placed in "Park", with the engine running. Preferably, the car or other vehicle has been driven at least 5,000 miles. The engine is permitted to reach approximately optimum operating temperature (which may vary, depending on the engine and/or vehicle involved). It may be preferred that the delivery device is oriented so that the distal end of the delivery conduit extends beyond the mass flow sensor. With the engine running at about 2000-about 3000 RPM (about 2000 RPM preferred), the actuator is engaged to the "open" position, and cleaning agent is dispensed into the air intake. Depending on the embodiment, the cleaning agent is dispensed in an aerosol format, an atomized format, a vapor format, a liquid stream format or a combination of any of these. A "dosage" amount in the range of about 150 to about 300 grams of cleaning agent may be preferred.

In some embodiments, it may be desirable to dispense the cleaning agent dosage in 2 to 5 substantially sequential aliquots. Once the dosage has been dispensed, it may be desirable to accelerate the engine two to three times, without exceeding about 3,500 RPM. The engine is turned off and the vehicle is left alone for about 30 to 60 minutes or about 50 to about 70 minutes or more. Subsequently, in some embodiments, the car is driven at highway speeds for about 10 minutes.

In an embodiment, upon practice of the invention one may realize a reduction in deposits on the surfaces of the intake valves of about 5% to about 20% or about 10% to about 15% by weight. Consequently, improvement in a variety of performance attributes of the engine may also be observed, such as reduced emissions, improved fuel economy, and/or increased power or torque.

EXAMPLES

Example 1

Preparation of Exemplary Cleaning Agent of the Invention

An illustrative cleaning agent of the invention is prepared as follows:

About 140 grams of diesel fuel is placed into a clean beaker. Subsequently, about 300 grams of a third-party proprietary detergent blend sold under the trade name POWERZOL 9543 is added to the beaker, followed by 4 grams of a third-party proprietary synthetic base fluid. The mixture is gently agitated to mix and loaded into a dispensing device to create the system of the invention.

Example 2

Evaluation of Deposit Reduction

A VW Jetta GLI's (2.0 L 14 Turbo) is subjected to a pre-test 10,000 mileage accumulation. The valves from the car are removed (8), their individual weights recorded, and they are replaced in the car's engine. An embodiment of the system of the invention is prepared by placing 200 grams of the cleaning agent of Example 1 and 100 grams of A-70 propellant in the reservoir of the dispensing device of the invention.

When the car's engine is at operating temperature, the entire amount of the cleaning fluid prepared in Example 1 is dispensed onto the surfaces of the intake valves by inserting the distal end of the delivery device into the air intake but beyond the mass flow sensor, while the engine is run at about 2000 RPM. After the entire amount of the cleaning agent is dispensed, the engine is accelerated up to 3000 RPM twice. The engine is turned off, and allowed to rest for 60 minutes. The vehicle is then driven on the Pennsylvania Turnpike at an average speed of 60 miles per hour for 20 minutes.

Figure 3:
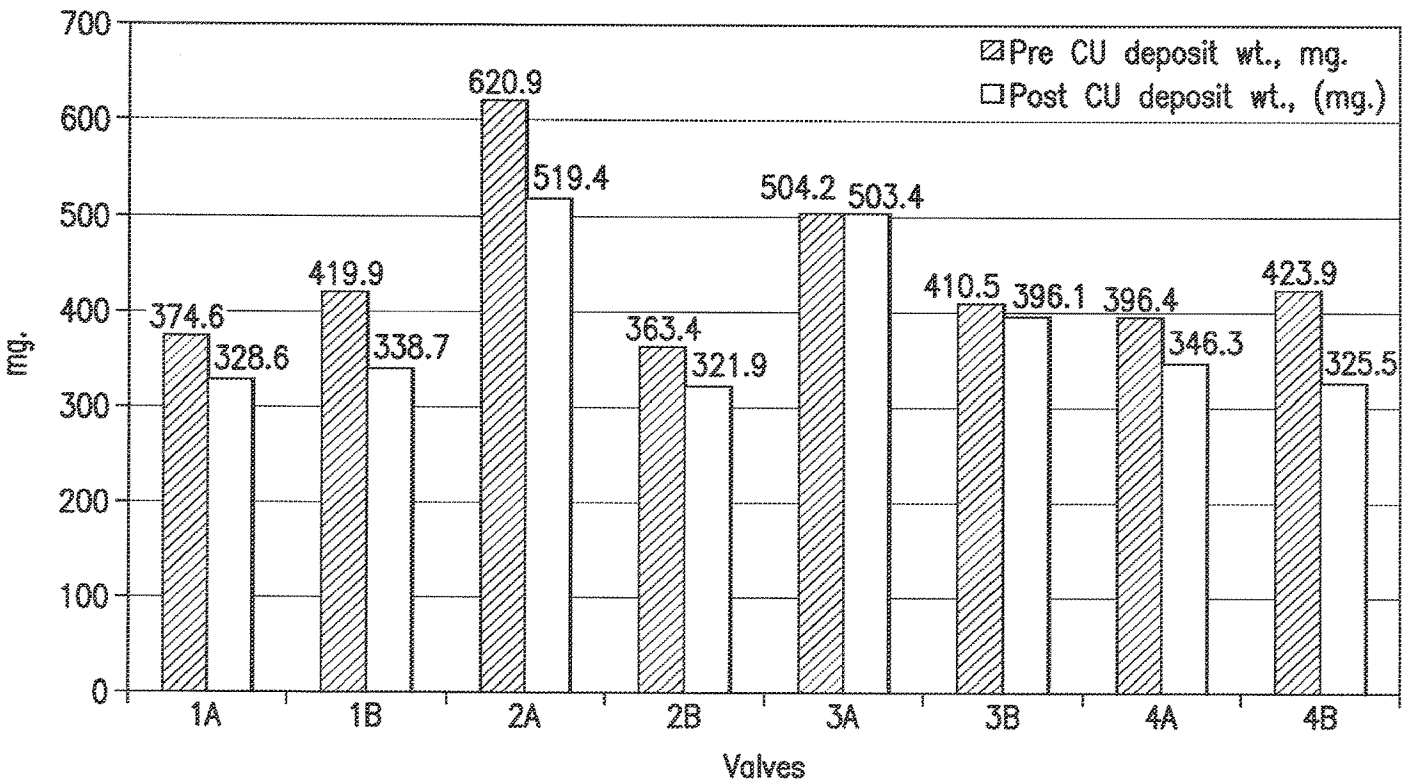
FIG. 3 is a bar graph presenting data obtained in the evaluation of the systems and methods of the invention.
Figure 4:
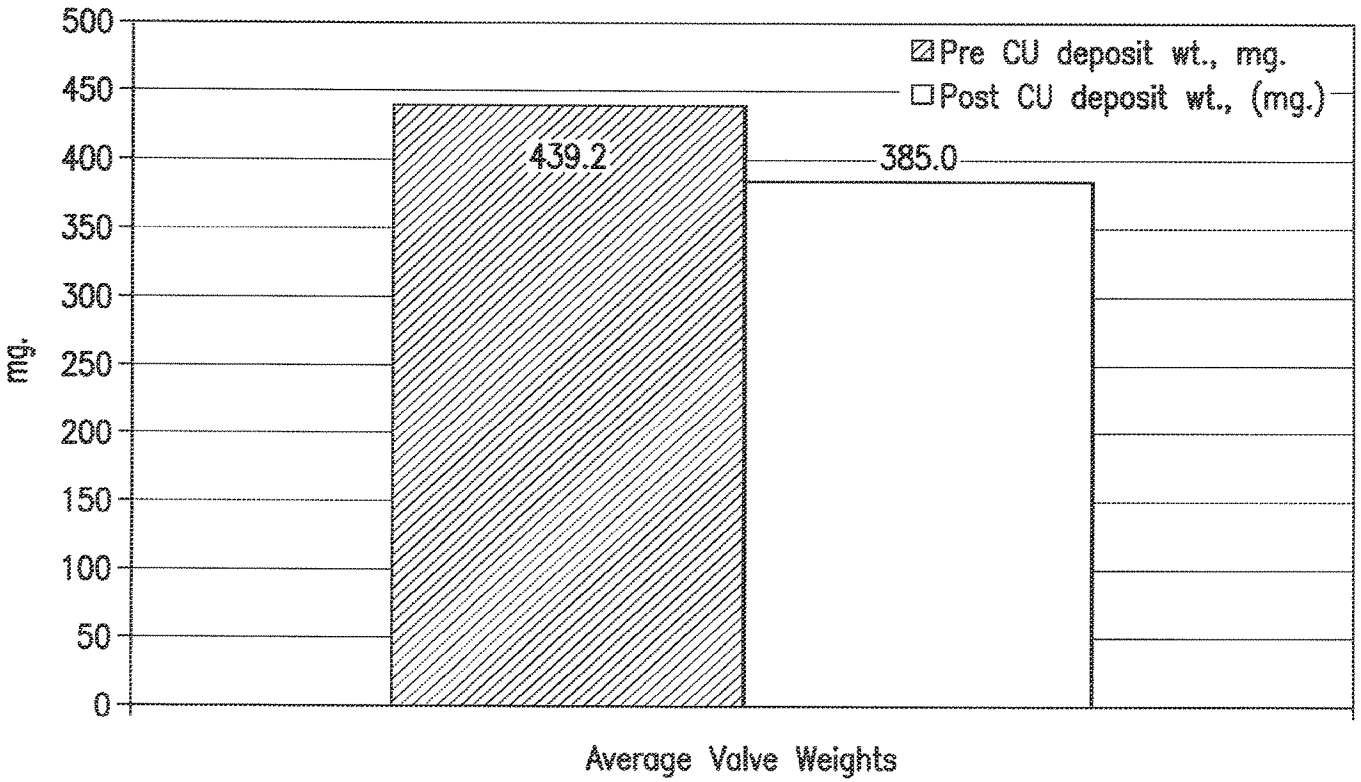
FIG. 4 is a is a bar graph presenting the data of FIG. 3 in aggregate.

The intake valves are removed from the car and weighed again. The difference in weight before and after use of the system of the invention is determined. The results for the valves (A, B) are shown in FIGS. 3 and 4. It can be seen that overall about 12% reduction by weight was realized.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A system to reduce deposits from a surface of an intake valve comprising;

a delivery device comprising a reservoir for holding a cleaning agent having a body defining an interior space and an outlet port in fluid communication with the interior space of the reservoir body, a delivery conduit extending from the reservoir body and terminating in a distal end and having a proximal end that is in fluid communication with the outlet port; and an actuator having an open position and a closed position, the reservoir containing a cleaning agent that comprises a detergent, a carrier, and a synthetic or petroleum derived oil, wherein upon activation of the actuator from the closed position to the open position, a portion of the cleaning agent flows from the interior space through the outlet port and is delivered under pressure to the distal end of the delivery conduit.

2. The system of claim 1, wherein the reservoir further contains an aerosol propellant.

3. The system of claim 2, wherein the propellant is selected in the group consisting of a compressed gas propellant, a soluble gas propellant, and a liquefied gas propellant.

4. The system of claim 2, wherein the propellant is selected from nitrogen gas, carbon dioxide, nitric oxide, compressed air, dimethyl ethers (DMEs), hydrofluorocarbons (HFCs), hydrofluorooefins (HFOs) hydrocarbon propellants and blends thereof.

5. The system of claim 4, wherein the propellant is selected from a methane, an ethane, a propane, a butane, a pentane and blends thereof.

6. The system of claim 4, wherein the propellant is selected from A-46, NP-46, NIP-46 and A-70.

7. The system of claim 1, wherein the reservoir is sited in a housing.

8. The system of claim 3, wherein the housing is selected from a metal housing, a cardboard housing, and a plastic housing.

9. The system of claim 1, wherein the delivery conduit extends about 5 to about 17 inches from the outlet port.

10. The system of claim 1, wherein the delivery conduit extends about 6 to about 10 inches from the outlet port.

11. The system of claim 1, wherein the cleaning agent comprises a detergent is a polyether amine.

12. The system of claim 1, wherein the cleaning agent comprises a detergent that is selected from the group consisting of polyisobutylene, (PIB)-Minnichs, (PIB)-amines, (PIB)-succinimide and mixtures thereof.

13. The system of claim 1, wherein the detergent is present in the cleaning agent in an amount of about 50% or greater by weight of the total cleaning agent.

14. The system of claim 1, wherein the carrier is a diesel fuel.

15. The system of claim 1, whereon the carrier is a petroleum distillate having a low vapor pressure.

16. The system of claim 1, wherein the oil is selected from the group consisting of polyols and high molecular weight mineral base oils.

17. The system of claim 1, wherein the oil is selected from a polyalphaolefin, a polyether, an ester and mixtures thereof.

18. The system of claim 1, wherein the cleaning agent is dispensed from the distal end of the delivery conduit in an atomized form.

19. The system of claim 1, wherein the cleaning agent is dispensed from the distal end of the delivery conduit in an aerosolized form.

20. The system of claim 1, wherein the cleaning agent is dispensed from the distal end of the delivery conduit in the form of a liquid stream.

21. A method of reducing emissions, improving fuel economy, and/or increasing power or torque of an engine in a vehicle having a GDI engine and which has been driven about 5,000 miles or greater comprising providing the system of claim 1, dispensing an effective amount of the cleaning agent into an air intake of the vehicle using the system while the engine is run at about 2000-3000 RPM to deliver the cleaning agent to a surface of an intake valve, turning off the engine and allowing the engine to rest for about 30 to about 60 minutes.

22. The method of claim 21 further comprising driving the car at a speed of about 50 to about 70 miles per hour for about 10 to about 30 minutes.

23. The method of claim 21 further comprising reducing a deposit on an intake valve by about 5% to about 20% by weight, as compared to the weight of the deposit prior to employment of the method.

24. The method of claim 21 further comprising reducing a deposit on an intake valve by about 10% to about 15% by weight, as compared to the weight of the deposit prior to employment of the method.

25. The method of claim 21 further comprising repeating the method after the car has been driven an additional 5,000 to 10,000 miles.

26. The method of claim 21, further comprising inserting the distal end of the delivery conduit of the delivery device into the air intake of the vehicle such that the distal end of the delivery conduit is beyond a mass flow sensor.

27. The method of claim 21, wherein dispensing an effective amount of the cleaning agent comprises dispensing the cleaning agent in one or more dosages each of about 150 to about 300 grams.

28. The method of claim 21, further comprising dispensing the cleaning agent, wherein with respect to the total weight of the cleaning agent, the detergent is present in an amount of 50% or more by weight, the carrier is present in an amount of 20% to about 50% by weight, and the oil is present in an amount of 0.1% to 5% weight.

29. A method of reducing or eliminating deposits from a surface of an intake valve comprising delivering to the surface an effective amount of a cleaning agent, wherein the cleaning agent comprises a detergent, a carrier, and an oil, and delivery is accomplished by use of the system of claim 1.

30. The system of claim 1, wherein the detergent of the cleaning agent is present in an amount of about 50% to about 70% by weight of the total weight of the cleaning agent.

31. The system of claim 30, wherein the carrier of the cleaning agent is present in an amount of about 20% to about 50% by weight of the total weight of the cleaning agent.

32. The system of claim 31, wherein the oil of the cleaning agent is present in an amount of 0.1% to about 5% by weight of the total weight of the cleaning agent.

33. A system to reduce deposits from a surface of an intake valve comprising:

an aerosol delivery device comprising a reservoir for holding a cleaning agent having a body defining an interior space and an outlet port in fluid communication with the interior space of the reservoir body, a delivery conduit extending from the reservoir body and terminating in a distal end and having a proximal end that is in fluid communication with the outlet port; and an actuator having an open position and a closed position, wherein the reservoir contains a cleaning agent that comprises a detergent, a carrier, a synthetic or petroleum derived oil, and a propellant, wherein upon activation of the actuator from the closed position to the open position, a portion of the cleaning agent flows from the interior space through the outlet port and is delivered under pressure to distal end of the delivery conduit.

34. The system of claim 33 wherein the detergent is selected from the group consisting of a polyether amine, a polyisobutylene, a (PIB)-Minnichs, a (PIB)-amines, a (PIB)-succinimide and mixtures thereof.

35. The system of claim 33 wherein the carrier is a petroleum distillate having a low vapor pressure.

36. The system of claim 33 wherein the oil is selected from the group consisting of a synthetic oil, a petroleum based oil, polyols, high molecular weight mineral base oils, a polyalphaolefin, a polyether, an ester and mixtures thereof.

37. The system of claim 33, wherein the propellant is selected in the group consisting of a compressed gas propellant, a soluble gas propellant, and a liquefied gas propellant.

38. The system of claim 33, wherein the propellant is selected from a methane, an ethane, a propane, a butane, a pentane and blends thereof.

39. The system of claim 33, wherein the propellant is selected from A-46, NP-46, NIP-46 and A-70.

* * * * *